US012721401B2

(12) United States Patent
Risatti et al.

(10) Patent No.: US 12,721,401 B2
(45) Date of Patent: Sep. 1, 2026

(54) OUTSOLES FOR FOOTWEAR

(71) Applicant: Diadora S.p.A., Caerano di San Marco (IT)

(72) Inventors: Michele Risatti, Caerano di San Marco (IT); Alessandro Sanfelici, Caerano di San Marco (IT); Sergio Antonio Puigcerver Palau, Valencia (ES); Enrique Jose' Medina Ripoll, Valencia (ES)

(73) Assignee: Diadora S.p.A., Caerano di San Marco (IT)

( * ) Notice: Subject to any disclaimer, the term of this patent is extended or adjusted under 35 U.S.C. 154(b) by 0 days.

(21) Appl. No.: 18/862,509

(22) PCT Filed: May 12, 2023

(86) PCT No.: PCT/IB2023/054926
§ 371 (c)(1),
(2) Date: Nov. 1, 2024

(87) PCT Pub. No.: WO2023/223162
PCT Pub. Date: Nov. 23, 2023

(65) Prior Publication Data

US 2025/0280920 A1 Sep. 11, 2025

(30) Foreign Application Priority Data

May 17, 2022 (IT) ..... 102022000010160

(51) Int. Cl.
*A43B 13/12* (2006.01)
*A43B 3/00* (2022.01)
*A43B 13/18* (2006.01)

(52) U.S. Cl.
CPC ..... *A43B 13/122* (2013.01); *A43B 3/0057* (2013.01); *A43B 13/127* (2013.01); *A43B 13/185* (2013.01)

(58) Field of Classification Search
CPC .... A43B 13/125; A43B 13/183; A43B 13/127
(Continued)

(56) References Cited

U.S. PATENT DOCUMENTS 3,036,389 A * 5/1962 Wesch ..... A63B 25/10 36/7.8
4,592,153 A * 6/1986 Jacinto ..... A43B 1/0054 36/38

(Continued)

FOREIGN PATENT DOCUMENTS

EP 3542660 A1 9/2019

OTHER PUBLICATIONS

International Search Report and Written Opinion in International Application No. PCT/IB2023/054926, mailed on Jun. 28, 2023, 9 pages.

*Primary Examiner* — Ted Kavanaugh
(74) *Attorney, Agent, or Firm* — MH2 Technology Law Group LLP

(57) ABSTRACT

An outsole for footwear may include: a heel portion; a central portion; a forefoot portion; and a reactive plate that extends from the heel portion toward the forefoot portion and that occupies the central portion of the outsole. The reactive plate may include a front section, a rear section, and an intermediate section between the front section and the rear section. The rear section of the reactive plate may be adjacent to an upper surface of the heel portion. The front section of the reactive plate may be adjacent to a lower
(Continued)

surface of the forefoot portion. The intermediate section of the reactive plate may be shaped in a form of an inverted Z or S.

20 Claims, 11 Drawing Sheets

(58) Field of Classification Search
USPC ..... 36/27
See application file for complete search history.

(56) References Cited

U.S. PATENT DOCUMENTS

| | | | | | |
|---|---|---|---|---|---|
| 5,060,401 | A * | 10/1991 | Whatley | A43B 13/18 | 36/114 |
| 5,279,051 | A * | 1/1994 | Whatley | A43B 13/181 | 36/114 |
| 8,510,970 | B2 * | 8/2013 | Baum | A43B 13/183 | 36/7.8 |
| 9,204,686 | B2 * | 12/2015 | Baum | A43B 13/181 | |
| 9,332,805 | B2 * | 5/2016 | Baum | A43B 13/37 | |
| 9,750,306 | B2 * | 9/2017 | Baum | A43B 13/188 | |
| 9,907,353 | B2 * | 3/2018 | Lester | A43B 13/187 | |
| 9,907,356 | B2 * | 3/2018 | Baum | A43B 13/183 | |
| 2011/0197470 | A1 * | 8/2011 | Caron | A43B 1/0072 | 36/43 |
| 2018/0168281 | A1 * | 6/2018 | Case | A43B 13/185 | |
| 2022/0053879 | A1 | 2/2022 | Redon et al. | | |
| 2022/0087362 | A1 | 3/2022 | Bardini et al. | | |

* cited by examiner

OUTSOLES FOR FOOTWEAR

CROSS-REFERENCE TO RELATED APPLICATION(S)

This application is a national stage entry from International Application No. PCT/IB2023/054926, filed on May 12, 2023, in the Receiving Office ("RO/IB") of the World Intellectual Property Organization ("WIPO"), published as International Publication No. WO 2023/223162 A1 on Nov. 23, 2023. International Application No. PCT/IB2023/054926 claims priority under 35 U.S.C. § 119 from Italian Patent Application No. 102022000010160, filed on May 17, 2022, in the Italian Patent and Trademark Office ("IPTO"), the entire contents of all of which are incorporated herein by reference.

The present invention relates to an outsole for footwear. In particular, the present invention relates to an outsole for footwear of the sporting type able to store part of the energy associated with the impacts acting on the outsole during walking or running movements and to release it partly to the user in a uniform manner, without hindering the user's movements.

More specifically, the present invention relates to an outsole for footwear able to reduce the energy expenditure of the user and improve his/her running economy, i.e. reduce the oxygen consumption of the user at a given speed.

The running economy is a parameter which is particularly useful for evaluating the performance of an athlete since, for the same speed, if an athlete consumes more oxygen than another athlete, he/she will probably have a worse performance. Outsoles for footwear which have tried to resolve these problems are known.

In particular, outsoles provided with a reactive plate made of carbon fibre inserted inside the midsole are known, "midsole" being understood as being the part of the outsole which is situated between the upper and tread and may be formed as one piece with the said tread. The function of the plate is to store part of the energy which is generated when the foot comes into contact with the ground and to release this energy during the push-off phase, when the foot is detached from the ground.

Usually the reactive plate is arch-shaped and extends from the heel zone to the forefoot zone occupied by the toes of the foot.

Examples of outsoles provided with such plates are described for example in U.S. Pat. No. 5,052,130 and WO 2016/179265.

These solutions, although widely appreciated, are not without defects.

In fact, the reactive plate allows recovery of only a minimal part of the kinetic energy which is produced during the walking or running movement since the material from which the midsole is made tends in fact to absorb part of the energy produced.

The object of the present invention is therefore to overcome at least partially the drawback mentioned above with reference to the prior art.

In particular, a first task of the present invention is to provide an outsole for footwear which is able to facilitate the walking or running movement of the user.

A further task of the present invention is to provide an outsole for footwear which, compared to the known solutions, is able to release to the lower limbs a greater amount of kinetic energy which is developed during the walking or running movement.

Furthermore, a task of the present invention is to provide an outsole for footwear which is able to provide suitable support for the foot during the walking or running movement without affecting the comfort which must be ensured for the user.

The object and tasks indicated above are achieved by an outsole for footwear in accordance with that claimed in Claim 1.

The characteristic features and further advantages of the invention will emerge from the description, provided hereinbelow, of some examples of embodiment, provided by way of a non-limiting example, with reference to the accompanying drawings in which.

Figure 15:
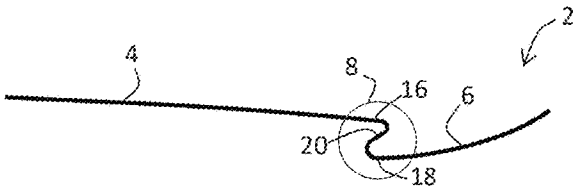
Figure 23:
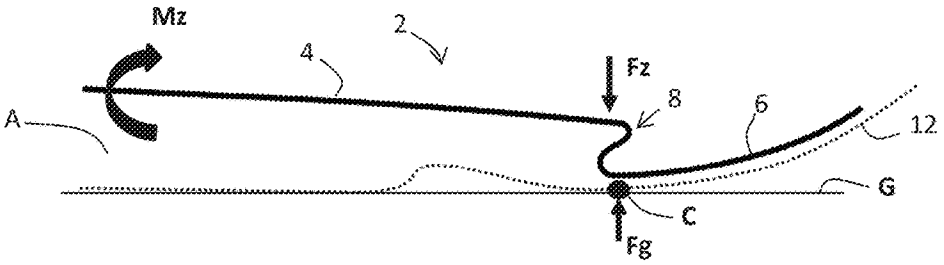
Figure 24:
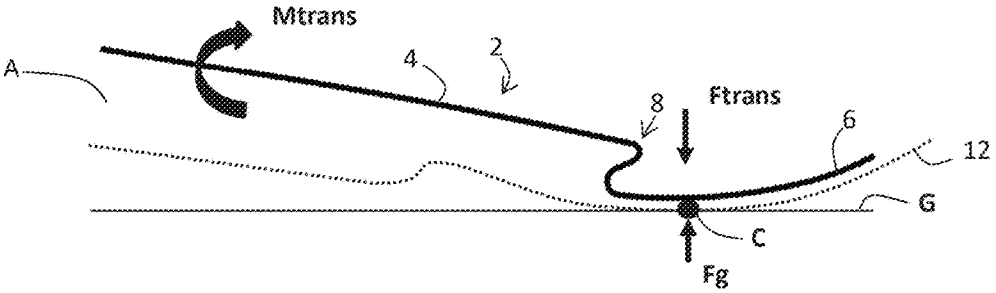
Figure 25:
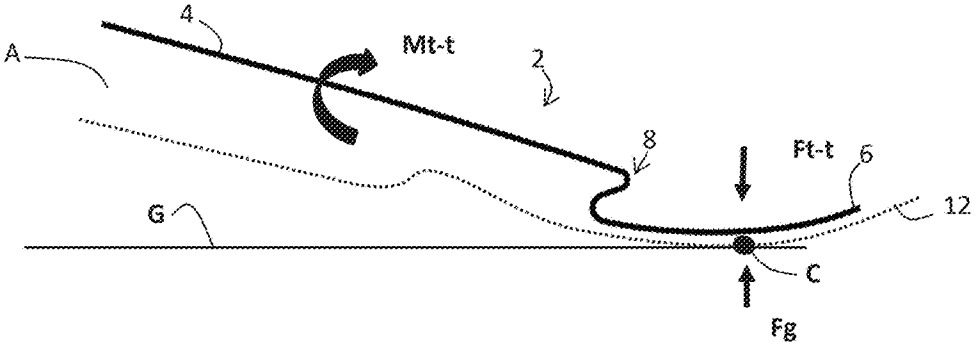

FIGS. 11, 13, 15, and 17 show respective side views of the reactive plates of the outsoles according to FIGS. 3, 5, 7 and 9;

FIGS. 12, 14, 16, and 18 show respective top plan views of the reactive plates according to FIGS. 11, 13, 15 and 17;

FIGS. 19-22 show respective perspective views of further embodiments of the reactive plates according to the invention;

FIGS. 23-25 shows schematically the reactive plate of FIG. 15, but in three different operating configurations.

The present invention relates to an outsole 1 for footwear, preferably sporting footwear, even more preferably running footwear. However, as will become clear from the description below, the outsole of the present invention may be advantageously applied also to walking or safety footwear.

In the continuation of the present description of the outsole 1 and its single components, "front" will be used to identify the part of the outsole, or of its single components, which during use is relatively closer to the toe of the foot, while "rear" will be used to identify the part of the outsole, or of its single components, which during use is relatively closer to the heel.

In a similar manner "upper" will be used to identify the part of the outsole, or of its single components, which during use is relatively farther from the ground, while "lower" will be used to identify the part of the outsole, or of its single components, which during use is relatively closer to the ground.

As shown in the attached figures, the outsole 1 comprises a heel portion A, a central portion B and a forefoot or toe portion C. The heel portion A of the outsole 1 is the portion on which the heel or rear foot rests, the central portion B of the outsole 1 is the portion on which the foot arch or midfoot rests, and the forefoot or toe portion C of the outsole 1 is the portion on which the forefoot rests.

In accordance with the invention, the outsole 1 also comprises a reactive plate 2, where reactive plate is understood as meaning a plate made using a material with elastic characteristics which allow the reactive plate to follow the movement of the user's foot during the walking or running movement.

As will be explained in detail below, the reactive plate 2 is able to deform elastically during the walking or running movement of the user, so as to accumulate elastic energy which, during the same walking or running movement, is released backed to the heel or to the forefoot of the user depending the walking or running phase.

Figure 1:
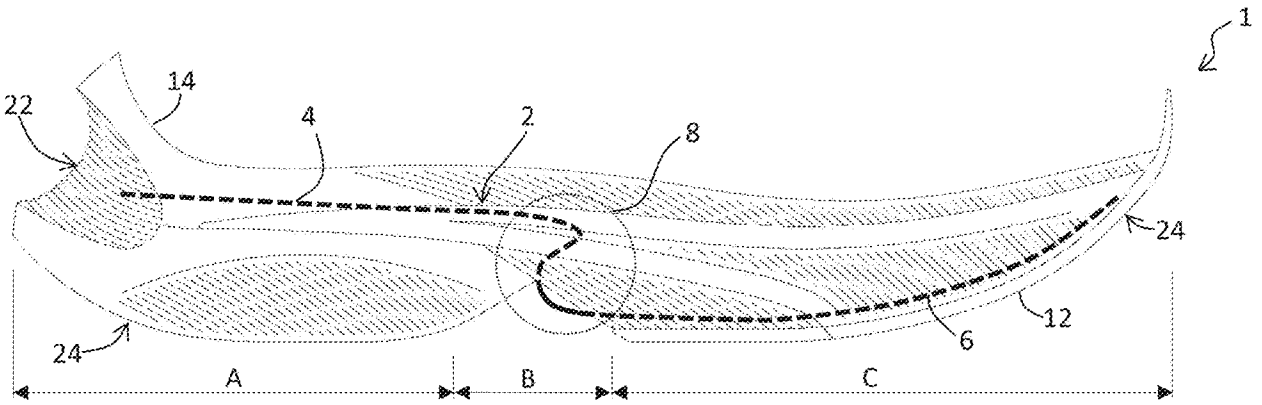
FIG. 1 shows schematically a side view of an outsole for footwear according to the invention.
Figure 2:
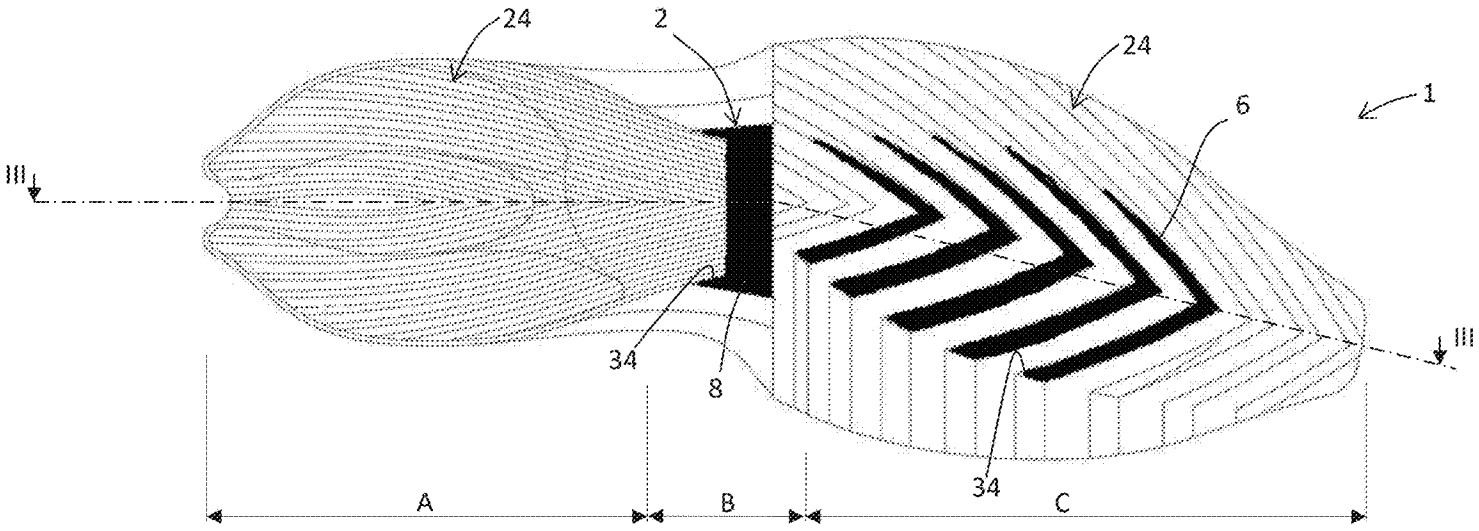
FIG. 2 shows schematically a bottom plan view of the outsole according to FIG. 1.

As shown for example in FIG. 1, the reactive plate 2 extends from the heel portion A towards the forefoot portion C, occupying the central portion B of the outsole 1.

In accordance with the invention, the reactive plate 2 has a rear section 4 arranged adjacent to the upper surface 10 of the heel portion A and a front section 6 arranged adjacent to the lower surface 12 of the forefoot portion C (see FIGS. 3, 5, 7 and 9).

Preferably, the rear section 4 of the reactive plate 2 is situated not more than 10 mm from the upper surface 10 of the heel portion A of the outsole 1.

In a preferred embodiment, the rear section 4 of the reactive plate 2 is situated not more than 5 mm from the upper surface 10 of the heel portion A of the outsole 1.

The front section 6 of the reactive plate 2, in turn, preferably is situated not more than 10 mm from the lower surface 12 of the forefoot portion C of the outsole 1, where "lower surface 12" of the forefoot portion C is understood as meaning the surface intended to come into contact with the ground.

In a preferred embodiment, the front section 6 of the reactive plate 2 is situated not more than 8 mm from the lower surface 12 of the forefoot portion C of the outsole 1.

In accordance with the invention, the reactive plate 2 also comprises an intermediate section 8 between the rear section 4 and the front section 6, which is shaped in the form an inverted Z or S. Below for the sake of simplicity reference will be made to the Z-shaped form.

As will become clear from the description below, the specific shape of the reactive plate, in combination with its specific positioning inside the outsole, result in the creation of an outsole which is able not only to transmit back part of the energy resulting from impact of the outsole with the ground during the walking or running movement, but also to release it at the suitable moment, during separation of the foot from the ground, and in the correct zone, in the region of the heel or of the forefoot depending on the walking or running phase.

Figure 3:
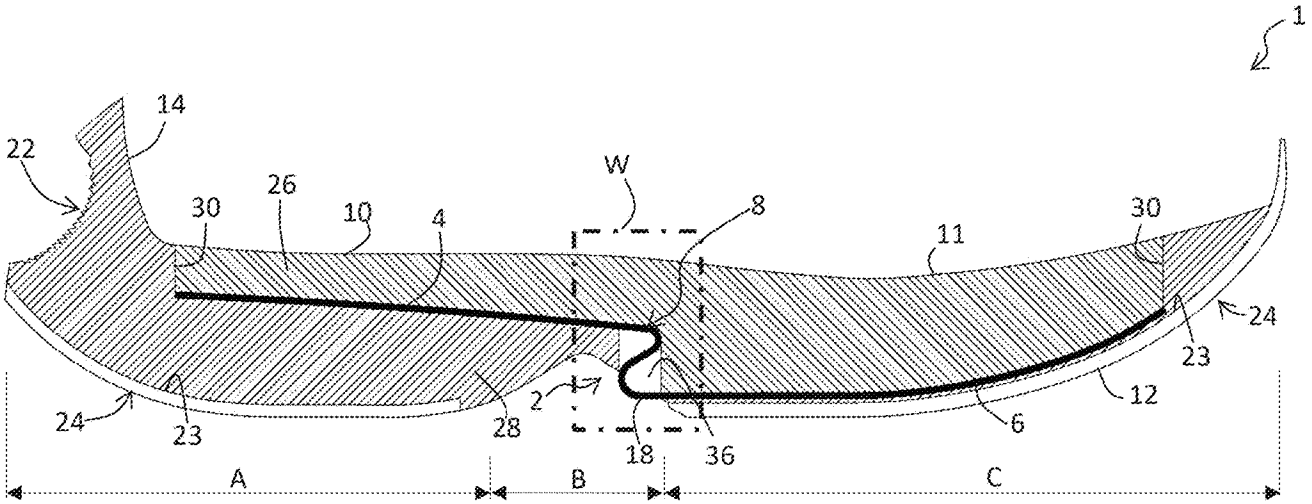
FIG. 3 shows schematically a cross-section along the line III-III of FIG. 2.
Figure 4:
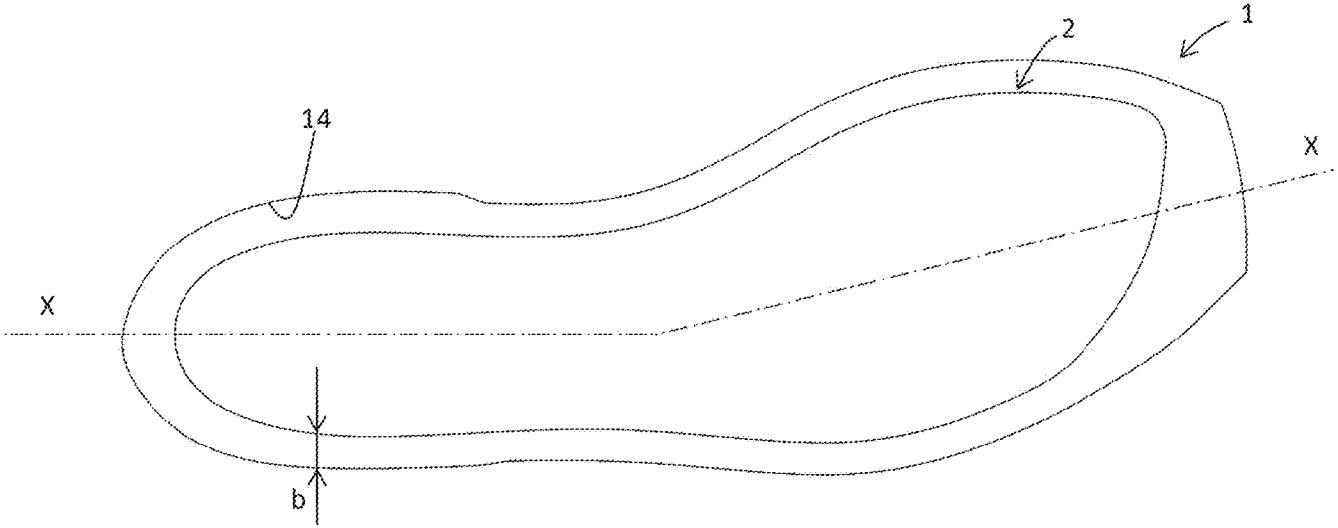
FIG. 4 shows schematically the positioning of the reactive plate with respect to the internal template of the outsole shown in FIG. 3.
Figure 3A:
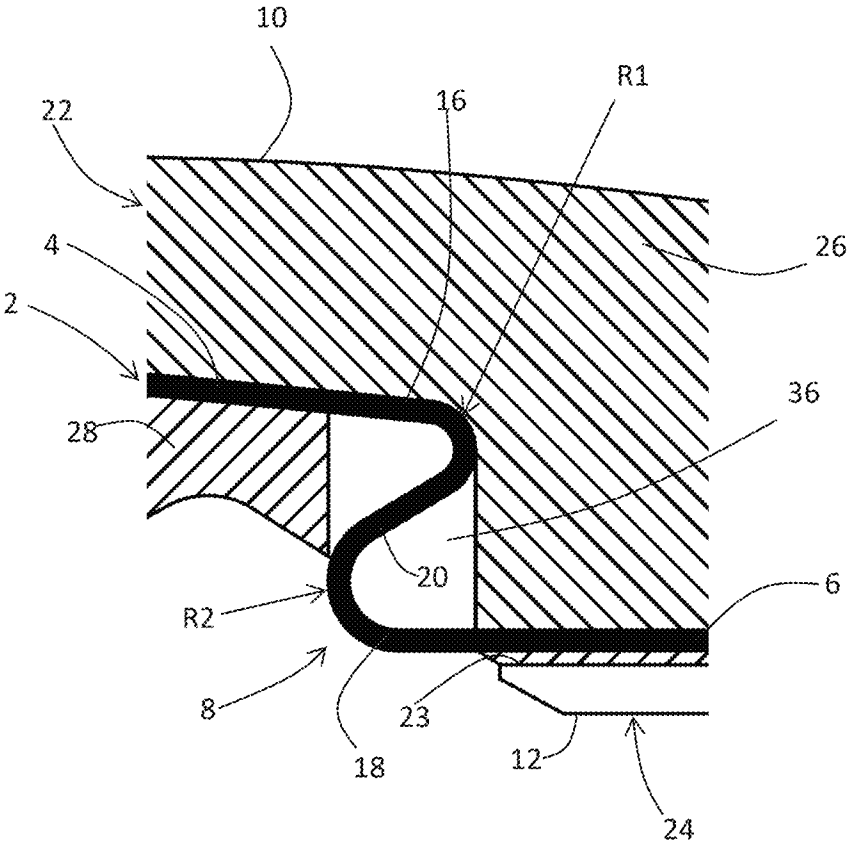
FIG. 3A shows a view, on a larger scale, of the detail of FIG. 3 indicated by the letter W.
Figure 5:
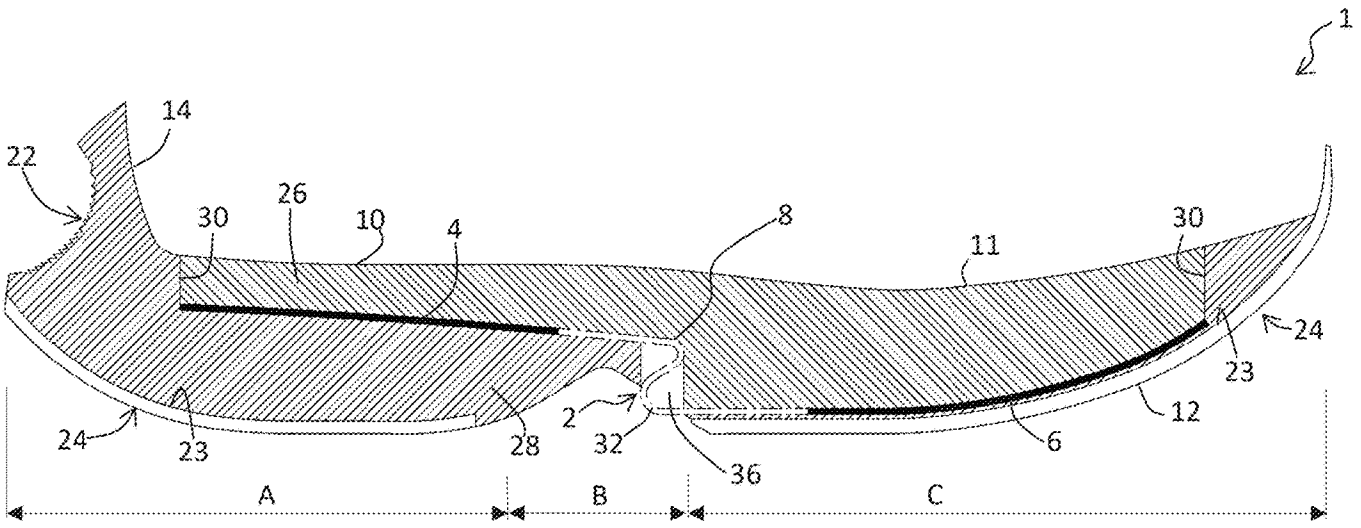
FIGS. 5, 7 and 9 are figures similar to FIG. 3, but relating to different embodiments of the outsole according to the invention.
Figure 6:
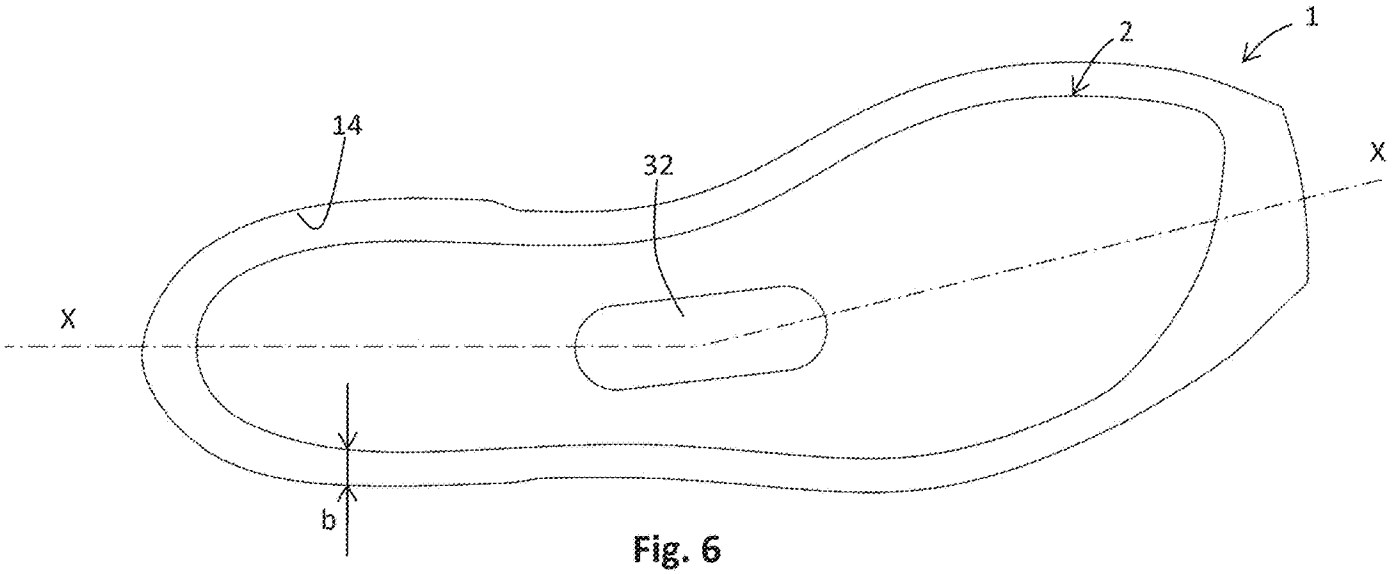
FIGS. 6, 8 and 10 are figures similar to FIG. 4, but relating to the embodiments of the outsole according to FIGS. 5, 7 and 9, respectively.

With reference to FIG. 3A, the intermediate section 8 of the reactive plate 2 comprises an upper part 16, a lower part 18 and a central part 20.

Advantageously, the upper part 16 is connected to the rear section 4, the lower part 18 is connected to the front section 6 and the central part 20 extends diagonally between the upper part 16 and the lower part 18.

Preferably, the connecting radii R1, R2 between the upper part 16 and the central part 20 of the plate 2 and between the central part 20 and the lower part 18 of the plate 2 are substantially the same or differ only slightly.

Alternatively, the connecting radius R2 between the central part 20 and the lower part 18 is greater than the connecting radius R1 between the upper part 16 and the central part 20.

Figure 7:
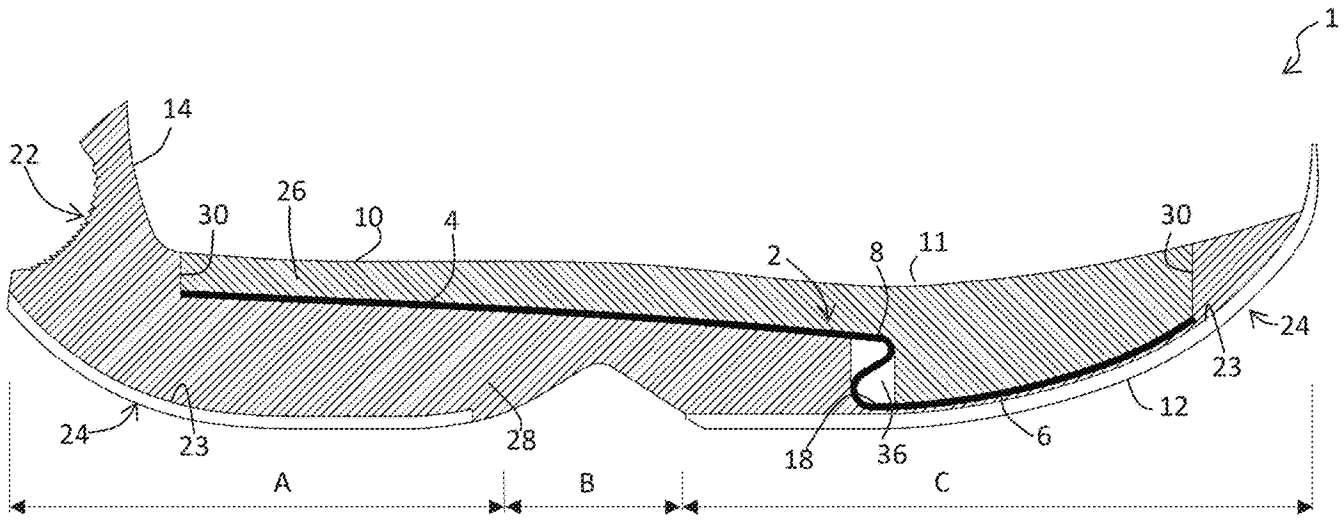

As shown in the detail of FIG. 3A and as is clearly visible also in FIGS. 3 and 7, the lower part 18 of the intermediate section 8 of the reactive plate 2 is preferably positioned adjacent to the lower surface of the outsole 1.

Advantageously, the intermediate section 8 of the plate 2 may be arranged in the central portion B of the outsole 1 (see FIGS. 1-6).

Alternatively, the intermediate section 8 of the plate 2 may be arranged in the forefoot portion C of the outsole 1 (see FIGS. 7-10). Advantageously, in this embodiment, the intermediate section 8 may be arranged in the zone 11 of the forefoot portion C intended to act as a support for the heads of the metatarsal bones of the user's foot.

This zone is located at a distance from the rear end of the outsole equal to about ⅔rds of the total length of the outsole.

Figure 8:
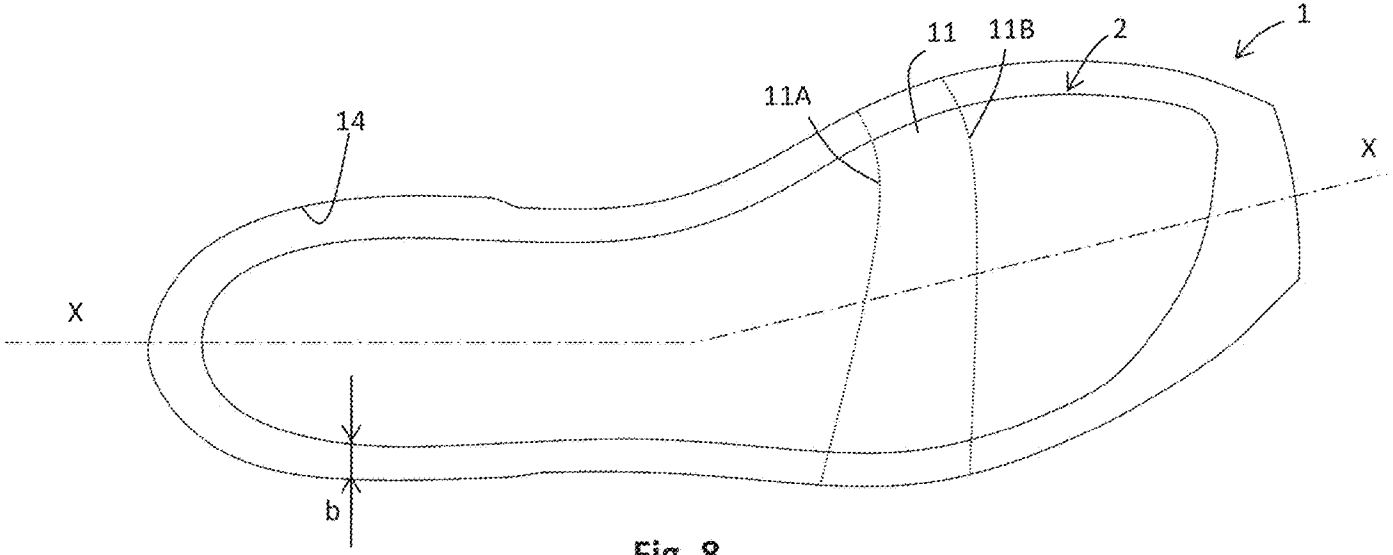
Figure 9:
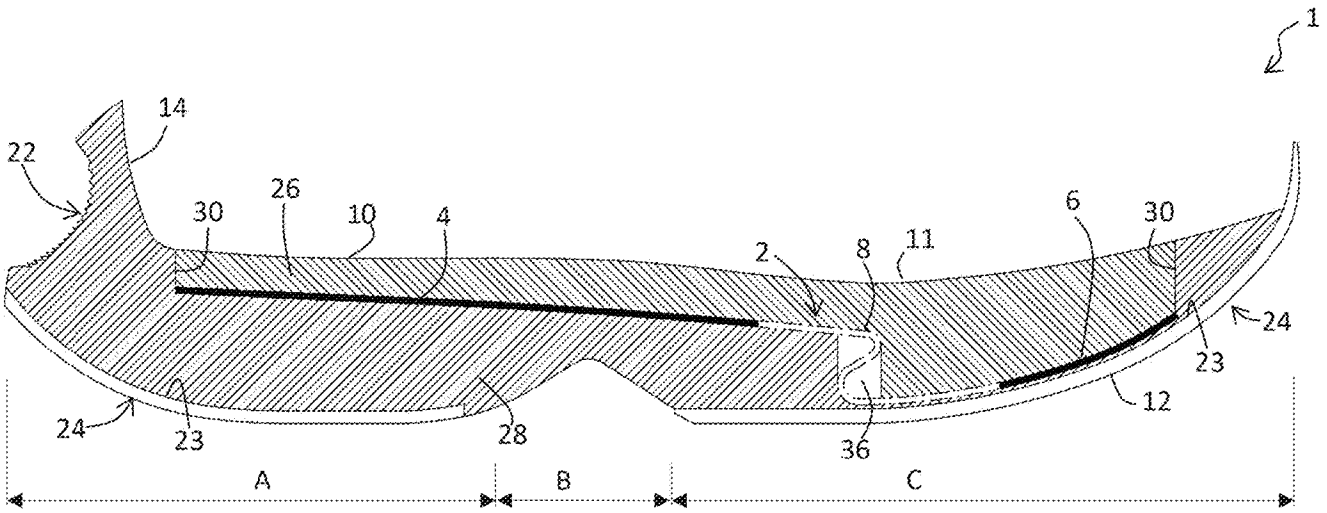
Figure 10:
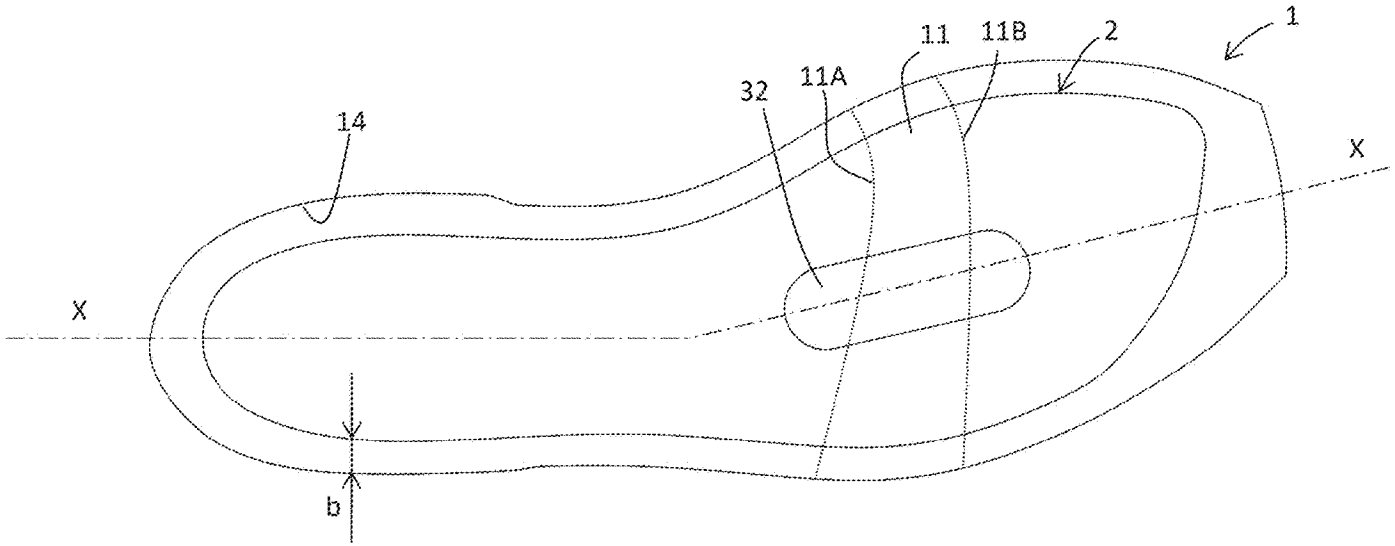
Figure 11:
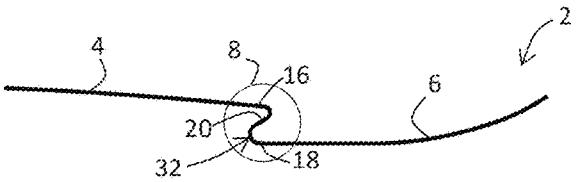
Figure 12:
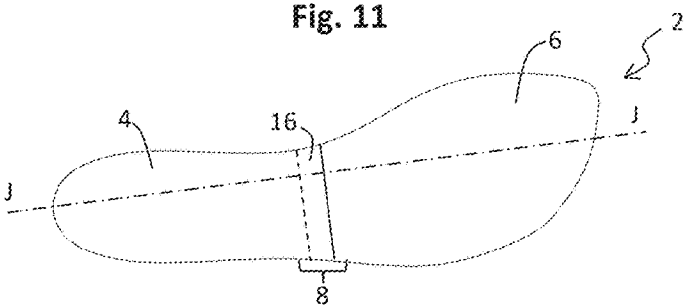
Figure 13:
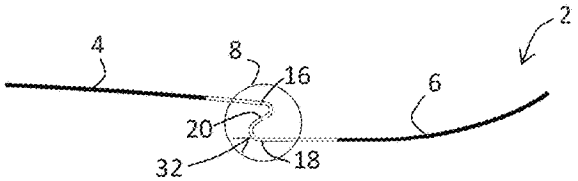
Figure 14:
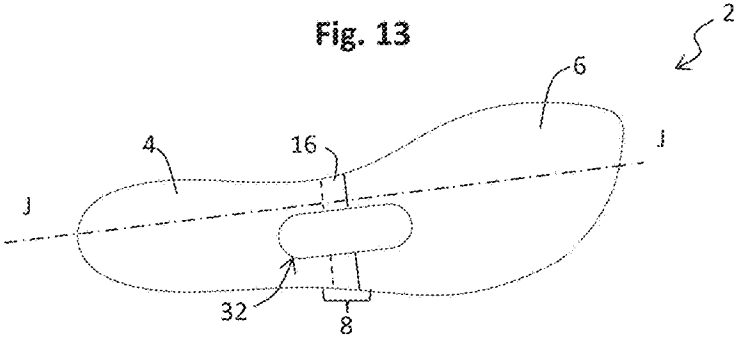

In FIGS. 8 and 10, the zone 11 is shown schematically defined by two curved lines 11A and 11B which take into account the fact that the distance of the heads of the metatarsal bones from the rear end of the heel of the foot varies depending on the foot size of different individuals.

By way of example, in the case of a man's foot size 42, measured using the French system, the head of the first metatarsal bone is usually situated at a distance from the rear end of the heel of between 185 mm and 202 mm, and, in the case of a woman's foot size 38, measured using the French system, the head of the first metatarsal bone is usually situated at a distance from the rear end of the heel of between 143 mm and 160 mm.

Similar considerations are also valid for the other metatarsal bone heads (second, third, fourth and fifth metatarsus) which are closer to the rear end of the heel than the head of the first metatarsal bone.

Advantageously, as shown in FIGS. 12, 14, 16 and 18, the intermediate section 8 of the plate 2 has a width, measured along the toe-to-heel axis J of the plate 2, substantially corresponding to the width of the upper part 16 of the intermediate zone 8. In particular, said width is between 1.0 and 3.5 cm, preferably between 2.0 and 2.5 cm.

With reference again to FIGS. 12, 14, 16 and 18, preferably the intermediate section 8 of the plate 2 is oriented so as to be perpendicular to the axis J.

With reference to FIGS. 11, 13, 15 and 17, the rear section 4 of the reactive plate 2 may be substantially flat, while the front section 6 of the reactive plate 2 has preferably an arched profile with its concavity facing upwards.

With reference to FIGS. 4, 6, 8 and 10, the perimetral profile of the reactive plate 2 follows substantially the profile 14 of the internal template of the outsole 1, being spaced from said profile 14 by an amount b, preferably of between 0.5 and 2.0 cm.

In some embodiments, the perimetral profile of the reactive plate 2 may at some points be spaced by a greater amount with respect to the profile of the internal template. For example, this amount may increase in the zone of the toe of the outsole or depending on the configuration of the shoe.

Reference is now made to FIGS. 19-22, in which for simpler illustration a reactive plate 2 with a linear outer profile is shown. The comments which follow are, however, valid also in the case where the outer profile of the plate is shaped as indicated above (see for example FIGS. 12, 14, 16 and 18).

Figure 20:
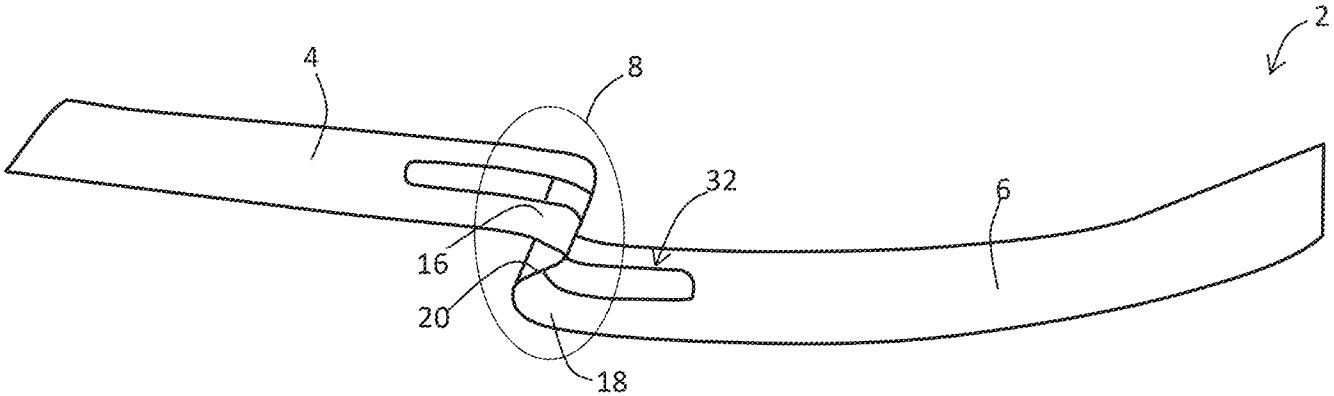
Figure 21:
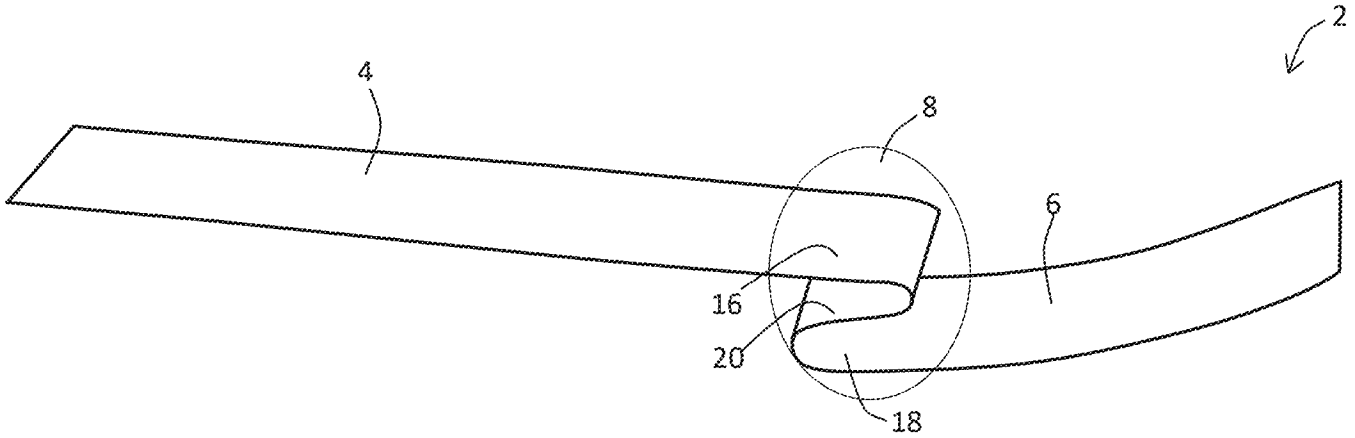
Figure 22:
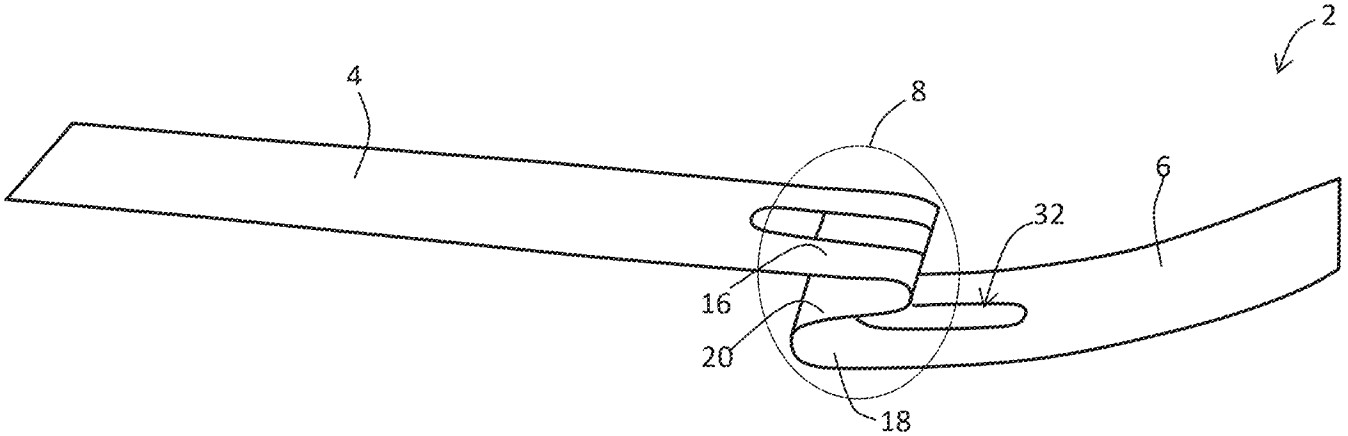

FIGS. 20 and 22 show a reactive plate 2 provided with a central opening or eyelet 32 arranged in the intermediate section 8 of the plate 2 and extending towards the rear section 4 and towards the front section 6.

The provision of this opening 32 advantageously results in a different reaction of the plate on the inner side and the outer side of the outsole. In particular, during the running phase, the opening 32 has the effect that the plate 2 reacts differently on the inner side and the outer side to the compressive forces acting on it, so as to follow the natural development of the podalic helix of the foot.

Preferably, the reactive plate 2 has a constant thickness of between 1.8 mm and 2.5 mm.

Advantageously, the reactive plate 2 is made of a technopolymer. Preferably, the plate 2 is made using a technopolymer having a polyamide or polyether block amide (PEBA) based matrix reinforced with carbon fibre or fibreglass.

With reference to FIGS. 1, 2, 3, 3A, 5, 7 and 9, the outsole 1 preferably comprises a midsole 22 and a tread 24. The tread 24 is a portion of the outsole intended to come into contact with the ground and the midsole 22 is the portion of the outsole situated between the upper of the shoe, onto which the outsole 1 is applied, and the tread 24.

The tread 24 is applied onto a lower surface 23 of the midsole 32.

The tread 24 may be applied onto the midsole 22 so as to cover the whole of the lower surface 23, optionally with lugs which extend along the heel and the toe. Alternatively, the tread 24 may be arranged along the heel portion A and the forefoot portion C, leaving the central portion B of the outsole 1 uncovered.

In this case, corresponding openings 34 may be arranged in the central portion of the midsole 22 and/or in the forefoot portion of the tread 24. Advantageously, the reactive plate 2 may be visible from the outside of the outsole through these openings (see FIG. 2).

The presence of the openings 34 also allows the overall weight of the outsole 1 to be reduced.

Advantageously, owing to the provision of the plate 2 in the central portion B of the outsole 1, it is possible to dispense with the inclusion of reinforcing shanks in the midsole. This function is in fact already performed by the plate 2.

Preferably, the midsole 22 comprises an upper element 26 and a lower element 28 which are separate from each other. As shown in the attached figures, the reactive plate 2 is interposed between the upper element 26 and the lower element 28. In this embodiment, the upper element 26 and the lower element 28 may be both visible laterally once the outsole has been applied onto the upper of the shoe. The plate 2, in turn, is sandwiched between these elements 26, 28 which are glued together.

Advantageously, a seat 30 suitable for housing the reactive plate 2 and the upper element 26 may be arranged in the lower element 28 of the midsole 22, Preferably, the seat 30 is provided in the lower element 28 so that the upper element 26, once inserted inside the seat 30, is flush with the upper surface of the lower element 28.

In this embodiment, the upper element 26 is not visible laterally once the outsole 1 has been applied onto the upper of the shoe. Only the lower element 28 will be visible.

Preferably, the upper element 26 and the lower element 28 of the midsole 22 are made of expanded polymeric material. Advantageously, both the lower element 28, arranged substantially between tread 24 and reactive plate 2, and the upper element 26, arranged during use between the user's foot and the reactive plate 2, may be made of a material with a high elasticity such as ethyl vinyl acetate (EVA) able to transmit back most of the impact energy received during the running or walking movement. Advantageously, the ethyl vinyl acetate (EVA) may be combined with expanded polyether block amide (PEBA), so as to obtain a greater spring back effect.

For this purpose, advantageously the ethyl vinyl acetate (EVA), before being loaded into the mould, may have nitrogen added to it so as to improve its elastic properties and reduce its density.

Alternatively, for the lower element 28 and the upper element 26 two different materials or materials which are the same, but have different properties, e.g. a different hardness, may be used.

As shown in the attached figures, the intermediate section 8 of the plate 2 may be housed inside an interspace 36 formed between the upper element 26 and the lower element 28 of the midsole 22, so as to facilitate moulding and assembly of the outsole.

The tread 24 may be made of a polymeric material such as TPU, TPR or vulcanised rubber.

Advantageously the thickness of the midsole 22, whether it be formed by a single element or by two separate elements, is substantially constant along the heel portion A and the forefoot portion C. This thickness may be between 3 and 5 cm.

Preferably the heel portion A has a greater thickness than the forefoot portion C. Advantageously, the difference between the thickness of the midsole along the heel portion A and the thickness along the forefoot portion C, which is known in technical jargon as "drop", is not greater than 5 mm.

The tread 24, in turn, has preferably a thickness of between 3 and 5 mm.

The aforementioned drop values advantageously allow the user's foot to rest on the ground also in the region of the foot arch, favouring the push-off action of the foot when running.

Moreover, by using smaller drop values, in combination with thicknesses of the midsole of the order of 4 cm in the forefoot portion, the greater will be the quantity of energy which, owing to the arrangement of the intermediate section 8 of the plate 2, may be transmitted back to the user's foot.

Figure 16:
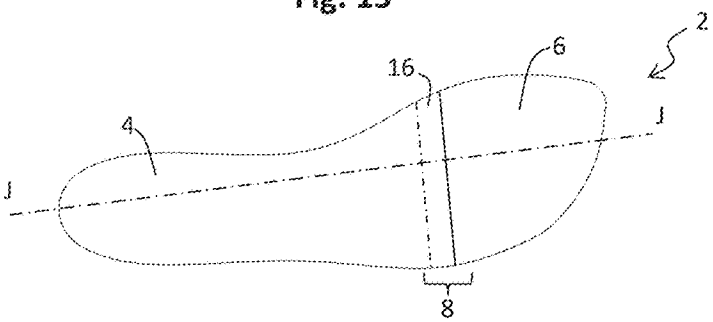
Figure 17:
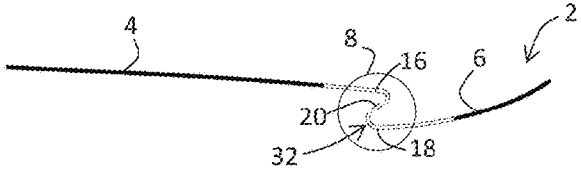
Figure 18:
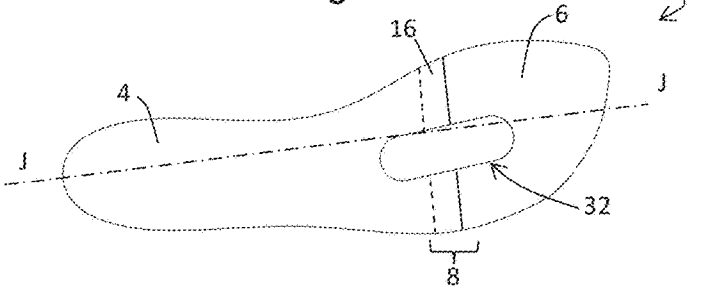
Figure 19:
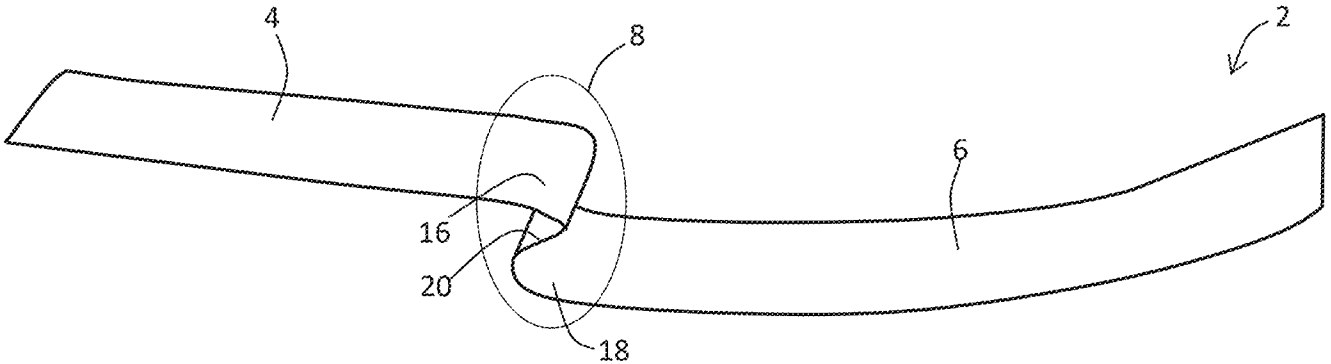

With reference to FIGS. 23 to 25 below the operating principle of the reactive plate 2 of the outsole according to the invention will be briefly described in connection with the embodiment of the plate 2 shown in FIGS. 7, 15 and 16.

The comments made below are, however, also applicable to the other embodiments shown in the attached figures.

In a manner known per se, the timing of the running movement may be comprised between two successive contact moments of the heel of the same foot and is formed by a so-called "stance phase", which forms about 60% of the entire cycle, and a swinging phase, which forms about 40% of the entire cycle.

The stance phase comprises in turn:

- a strike phase, where the heel of the foot comes into contact with the support surface;
- a support phase, where the entire foot-sole area is contact with the support surface;
- a push-off phase, where the toes of the foot are still in contact with the support surface, while the heel of the foot is raised from the ground.

The swinging phase occurs instead between lifting of the toes of the foot from the ground and the subsequent heel strike of the same foot.

FIGS. 23-25 schematically show three situations which arise during the foot stance phase (FIG. 23) and during the push-off phase (FIGS. 24 and 25).

During the foot stance phase, when the forefoot portion of the outsole strikes the ground (this impact is indicated schematically by means of the arrow Fg), the intermediate section 8 of the plate undergoes a compression Fz, which allows part of the impact energy to be stored.

The Z-shaped form of the intermediate section 8 has in fact the effect that the upper part 16, owing to the flexing movement of the central part 20, is able to move closer towards the lower part 18, storing a corresponding amount of elastic energy.

The compression of the intermediate section 8 is facilitated by the fact that the midsole, and in particular the upper element, is made of a material which has a high elasticity. This material on the one hand favours compression of the intermediate section 8 of the plate 2, and on the other hand ensures that the user's foot does not sense any discomfort due to the presence of the Z-shaped intermediate section.

At the same time, the force Fz, owing to the particular Z-shaped configuration of the intermediate section, produces a moment Mz which exerts an upwards thrust of the rear section 4 of the plate 2, favouring separation of the heel portion A of the outsole 1 from the ground G.

During the next phase (see FIG. 24), the heel portion A of the outsole 1 is separated from the ground, while the point of contact C between the forefoot portion of the outsole and the ground moves towards the toe end following swinging of the forefoot portion.

The force Ftrans acting on the plate 2, owing to the concave profile of the front section 6 of the plate 2, therefore generates a moment Mtrans which, even if of smaller intensity than the moment Mz, continues to give rise to an upwards thrust along the rear section 4 of the plate, so as to facilitate the separation of the heel portion A of the outsole 1 from the ground G.

During this phase, there is also an initial release of the elastic energy stored in the intermediate section 8 of the plate 2.

Finally, during the next phase (see FIG. 25), the point of contact C between outsole and ground moves further towards the toe end of the outsole.

During this phase, which corresponds to the upwards push-off phase of the foot, i.e. so-called rolling phase, the force Ft-t acting on the plate 2 is displaced further towards the toe end of the foot. This force Ft-t also gives rise to the moment Mt-t acting on the rear section 4 of the plate 2, so as to provide a further upwards thrust along the heel portion A of the outsole 1.

The concave profile of the front section 6 of the plate 2 which is arranged adjacent to the lower surface of the outsole, together with the Z-shaped form of the intermediate section 8, are such that a so-called "teeter-totter effect" is created, this facilitating separation of the toes of the foot during the push-off phase.

The push-off phase is moreover facilitated by the complete release of the elastic energy stored during the previous phases in the intermediate section 8 of the plate 2.

In this way, the running movement is facilitated without there being any reduction in the comfort.

At this point it is clear how the provision on the inside of the outsole of the reactive plate 2 with a Z-shaped intermediate section, arranged adjacent to the upper surface of the outsole along the heel portion and adjacent to the lower surface of the outsole along the forefoot portion, maximizes the release of the energy stored by the outsole during the running movement.

In particular, the Z-shaped form of the intermediate section facilitates flexing of the reactive plate, making the shoe less rigid, and favours greater energy storage in the intermediate zone, so as to maximize the transfer of this energy to the heel of the user owing to the "teeter-totter" effect produced.

The person skilled in the art, in order to satisfy specific needs, may make modifications to the embodiments of the outsole and and/or replace the elements described with equivalent elements, without thereby departing from the scope of the attached claims.

The invention claimed is:

1. An outsole for footwear, the outsole comprising:
- a heel portion;
- a central portion;
- a forefoot portion; and
- a reactive plate that extends from the heel portion toward the forefoot portion and that occupies the central portion of the outsole;
- wherein the reactive plate comprises a front section, a rear section, and an intermediate section between the front section and the rear section,
- wherein the rear section of the reactive plate is adjacent to an upper surface of the heel portion,
- wherein the front section of the reactive plate is adjacent to a lower surface of the forefoot portion, and
- wherein the intermediate section of the reactive plate is shaped in a form of an inverted Z or S.

2. The outsole of claim 1, wherein the intermediate section of the reactive plate comprises an upper part, a lower part, and a central part,
- wherein the upper part is connected to the rear section of the reactive plate,
- wherein the lower part is connected to the front section of the reactive plate, and
- wherein the central part extends diagonally between the upper part and the lower part.

3. The outsole of claim 2, wherein the lower part of the intermediate section of the reactive plate is adjacent to a lower surface of the outsole.

4. The outsole of claim 1, wherein the intermediate section of the reactive plate is in the central portion of the outsole.

5. The outsole of claim 1, wherein the intermediate section of the reactive plate is in the forefoot portion of the outsole.

6. The outsole of claim 1, wherein the rear section of the reactive plate is substantially flat, and
- wherein the front section of the reactive plate has an arched profile with a concavity of the arched profile facing upwards.

7. The outsole of claim 1, further comprising:
- a midsole; and
- a tread;
- wherein the tread is applied onto a lower surface of the midsole.

8. The outsole of claim 7, wherein the midsole comprises an upper element and a lower element,
- wherein the upper element and the lower element are separate from each other, and
- wherein the reactive plate is between the upper element and the lower element.

9. The outsole of claim 8, further comprising a seat, suitable for housing the reactive plate and the upper element, in the lower element.

10. The outsole of claim 7, wherein the tread is along the heel portion and the forefoot portion of the outsole, leaving uncovered the central portion of the outsole, and wherein openings are in the central portion of the midsole and/or in the forefoot portion of the tread, through which the reactive plate is visible from an outside of the outsole.

11. The outsole of claim 1, wherein the reactive plate is provided with a central opening in the intermediate section of the reactive plate, extending toward the rear section and toward the front section of the reactive plate.

12. The outsole of claim 1, wherein the intermediate section of the reactive plate has a width, measured along a toe-to-heel axis, greater than or equal to 1.0 centimeters (cm) and less than or equal to 3.5 cm.

13. The outsole of claim 12, wherein the intermediate section of the reactive plate is oriented perpendicular to the toe-to-heel axis.

14. The outsole of claim 1, wherein the intermediate section of the reactive plate comprises an upper part, a lower part, and a central part.

15. The outsole of claim 14, wherein the upper part is connected to the rear section of the reactive plate.

16. The outsole of claim 14, wherein the lower part is connected to the front section of the reactive plate.

17. The outsole of claim 14, wherein the central part extends diagonally between the upper part and the lower part.

18. The outsole of claim 1, wherein the rear section of the reactive plate is substantially flat.

19. The outsole of claim 1, wherein the front section of the reactive plate has an arched profile with a concavity of the arched profile facing upwards.

20. The outsole of claim 1, wherein the intermediate section of the reactive plate has a width, measured along a toe-to-heel axis, greater than or equal to 2.0 centimeters (cm) and less than or equal to 2.5 cm.

* * * * *